US008277366B2

(12) United States Patent
Savane

(10) Patent No.: US 8,277,366 B2
(45) Date of Patent: Oct. 2, 2012

(54) COLLAPSIBLE STEP EXERCISING MACHINE

(76) Inventor: Mahamadou Savane, Bronx, NY (US)

( * ) Notice: Subject to any disclaimer, the term of this patent is extended or adjusted under 35 U.S.C. 154(b) by 56 days.

(21) Appl. No.: 12/938,197

(22) Filed: Nov. 2, 2010

(65) Prior Publication Data

US 2011/0045955 A1 Feb. 24, 2011

Related U.S. Application Data

(63) Continuation-in-part of application No. 12/077,911, filed on Mar. 21, 2008, now abandoned.

(60) Provisional application No. 60/919,109, filed on Mar. 21, 2007.

(51) Int. Cl.
*A63B 22/04* (2006.01)

(52) U.S. Cl. ..... 482/52; 482/112

(58) Field of Classification Search ..... 482/51, 482/52, 53, 54, 56, 57, 62, 70, 908, 910, 482/111, 112; D21/662, 665, 668, 670; 601/23, 601/27, 31, 32, 33, 34, 35, 36
See application file for complete search history.

(56) References Cited

U.S. PATENT DOCUMENTS

| | | | | |
|---|---|---|---|---|
| 5,407,407 | A * | 4/1995 | Lin | 482/53 |
| 5,782,722 | A * | 7/1998 | Sands et al. | 482/52 |
| D484,930 | S * | 1/2004 | Yang | D21/670 |
| 2002/0183663 | A1 * | 12/2002 | Lu et al. | 601/28 |
| 2005/0064996 | A1 * | 3/2005 | Chen | 482/53 |
| 2005/0181914 | A1 * | 8/2005 | Radkowski et al. | 482/83 |
| 2006/0240955 | A1 * | 10/2006 | Pu | 482/79 |
| 2007/0238584 | A1 * | 10/2007 | Lee | 482/57 |

* cited by examiner

*Primary Examiner* — Loan Thanh
*Assistant Examiner* — Tam Nguyen
(74) *Attorney, Agent, or Firm* — Montgomery Patent & Design, LLC; Robert C. Montgomery; Joseph Yaksich

(57) ABSTRACT

A portable stair-stepping exercise machine having independent movable stepping pedals for each foot along with an independent pneumatic or hydraulic cylinder is herein disclosed. A support arm and bracket either collapses or comes apart for storage and transportation. The machine is generally of a smaller size and profile than its conventional counterparts and as such, its size and weight make it ideal to be transported while traveling, or for use in an area with restricted space in which the machine must be stored away after use.

19 Claims, 8 Drawing Sheets

COLLAPSIBLE STEP EXERCISING MACHINE

RELATED APPLICATIONS

The present application is a continuation-in-part of and claims the benefit of U.S. application Ser. No. 12/077,911 filed Mar. 21, 2008 now abandoned, the entire disclosures of which are incorporated herein by reference. The present invention was first described in and claims the benefit of U.S. Provisional Patent No. 60/919,109 filed Mar. 21, 2007, the entire disclosures of which are incorporated herein by reference.

FIELD OF THE INVENTION

The present invention describes an exercising machine providing a means for exercising simulating a stepping movement comprising a pair of independently movable stepping pedals mounted on shock absorbers located on a base frame and a collapsible vertical support member with a handlebar assembly to provide an ease for transporting and storing said exercise machine.

BACKGROUND OF THE INVENTION

Fewer than 100 manufacturers of fitness equipment operate in the U.S., with combined annual sales of about three billion dollars ($3,000,000,000). Major products are aerobic exercisers and strength training and traditional weightlifting equipment. In addition, there is a large number of supplementary products. This type of equipment allows individuals to exercise by themselves in a limited space. The two (2) major market segments for fitness equipment are the home and the institutional exercise equipment market. The home market is by far the largest and has grown significantly in the past decade.

Physical fitness and health considerations are areas of highest concern among Americans today. More than ever, people are frequenting health clubs and performing exercise routines at home in order to lose weight, improve muscle tone and maintain a healthy lifestyle. Many people are turning to exercise machines such as treadmills, weight machines, stationary bicycles and the like to help in these endeavors. A recent addition to such machines is the stair stepping machine, which mimics the motion required to climb a flight of stairs. Such machines do an excellent job but they are often large in size and suitable for use only in a permanent gym or exercise room setup. Those with limited space at home, or those who wish to use a stair stepping machine while traveling, are often out of luck.

Various attempts have been made to provide stepping type exercise machines. Examples of these attempts can be seen by reference to several U.S. patents. U.S. Pat. No. 6,582,343 filed by Lin and Chen discloses an adjustable step exerciser.

U.S. Pat. No. 6,387,014 filed by Lai discloses a foldable body building device.

U.S. Pat. No. 5,803,880 filed by Allen discloses a stepper/climber exerciser.

U.S. Pat. No. 5,658,222 filed by Brown discloses portable personal gym aerobic exercise equipment.

U.S. Pat. No. D,369,390 filed by Haber et al. discloses a ladder climbing exerciser.

U.S. Pat. No. 5,407,407 filed by Lin discloses a foldable stepping exerciser assembly.

U.S. Pat. No. 5,403,254 filed by Lundin and Stevens discloses a foldable step climber exerciser machine.

U.S. Pat. No. 5,222,927 filed by Chang discloses a collapsible stepper climber exerciser.

U.S. Pat. No. 4,900,012 filed by Fu discloses a leg exercising system.

While these devices fulfill their respective, particular objectives, each of these references suffer from one (1) or more of the aforementioned disadvantages. Many such apparatuses are not fully collapsible. Also, many such apparatuses are not collapsible and transportable without disassembly or use of tools. Furthermore, many such apparatuses are not widely adjustable to accommodate a variety of users. Accordingly, there exists a need for a collapsible step exercising machine without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a stepping exercise machine which is readily transportable for use in a variety of locations while providing a large range of positional and athletic adjustability to accommodate a variety of users. Thus, the object of the present invention is to solve the aforementioned disadvantages and provide for this need.

To achieve the above objectives, it is an object of the present invention to provide a step exercise machine for developing muscle groups through emulation of a stair climbing motion. The apparatus comprises base which supports a pair of pneumatically-operated stepping pedals. The apparatus further comprises a handlebar grip to help support the user during use.

Another object of the present invention is to a user to collapse the apparatus for purposes of transport and storage. The handlebar grip is supported by a first lower support member, a second lower support member, and an upper support member which are selectively foldable during periods of non-use.

Yet still another object of the present invention is to provide workout capabilities to the user in a variety of locations due to the apparatus' transportability. The apparatus further comprises a plurality of foot pads which prevent scraping, scratching or other damage to a floor surface during use.

Yet still another object of the present invention is to allow a user to selectively secure the first lower support member, the second lower support member, and the upper support member in an upright position during periods of use. The first lower support member and second lower support member are rotatingly attached to a median member located at a front end of the base. The median member houses a pair of first knobs which motion the first lower support member and second lower support member between a plurality of clamping blocks in order to allow the user to selectively tighten the knobs and clamp the supports in place at a desired angle. The upper support member is similarly connected to the first and second lower support members and similarly adjustable using a second knob. The handlebar grip is further similarly adjustable relative to the upper support using a third knob such that the user can position the grip in a desired height and position for use.

Yet still another object of the present invention is to comprise a pair of high-friction treads covering a top surface of each stepping pedal to provide a non-slip and a vibration-reducing function for the user during an exercise activity.

Yet still another object of the present invention is to provide a step-like exercising function for the user using a pair of pneumatic shock absorbers disposed underneath each stepping pedal. When the user applies a downward stepping force to each stepping pedal, the respective subjacent pneumatic shock absorber applies a counteractive resistive force.

Yet still another object of the present invention is to return each stepping pedal to a raised position with a spring unit once the user removes a downward force in order to facilitate repetitive stepping motion exercises.

Yet still another object of the present invention is to allow the user to selectively adjust the amount of resistive force applied by the pneumatic shock absorber based upon their preferences or strength. Each of the pneumatic shock absorbers comprises a motion control feature further comprising a needle valve device which controls a flow of hydraulic fluid through an internal hydraulic circuit within the shock absorber.

Yet still another object of the present invention is to provide a method of utilizing the device that provides a unique means of placing the apparatus on a desired ground or floor surface; loosening the first and second knobs; pivotally extending the first and second lower support members and the upper support member about the first pivoting member to a generally vertical position perpendicular to the base; securing the first and second lower support members and the upper support member in position by tightening the first and second knobs; loosening the third knobs; pivotally extending the handlebar upwardly to a generally horizontal orientation; adjusting the handlebar to obtain a desired grasping height thereof; tightening the third knobs to secure a position of the handlebar; pivoting each of the pneumatic shock absorbers upwardly therefrom the shock absorber cavities about the fourth pivoting member; inserting the cylinder shaft portions of said pneumatic shock absorbers therein respective couplings; adjusting the resistance level of the pneumatic shock absorbers, as desired; grasping the handlebar grip portion of the handlebar; stepping upon the stepping pedals with both feet; initiating a stepping exercise motion by depressing one (1) stepping pedal downwardly whilst the opposing stepping pedal is released thereto a raised position by removing one's applied weight therefrom; releasing one's weight thereupon said depressed pedal allowing it to return to a raised position while coincidentally depressing the opposing stepping pedal; alternating a depressing and releasing motion in rhythmic manner for a period of time to complete an exercise session; and, benefiting from reduced size, portability, and quick set-up of the apparatus regardless of a user's location.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
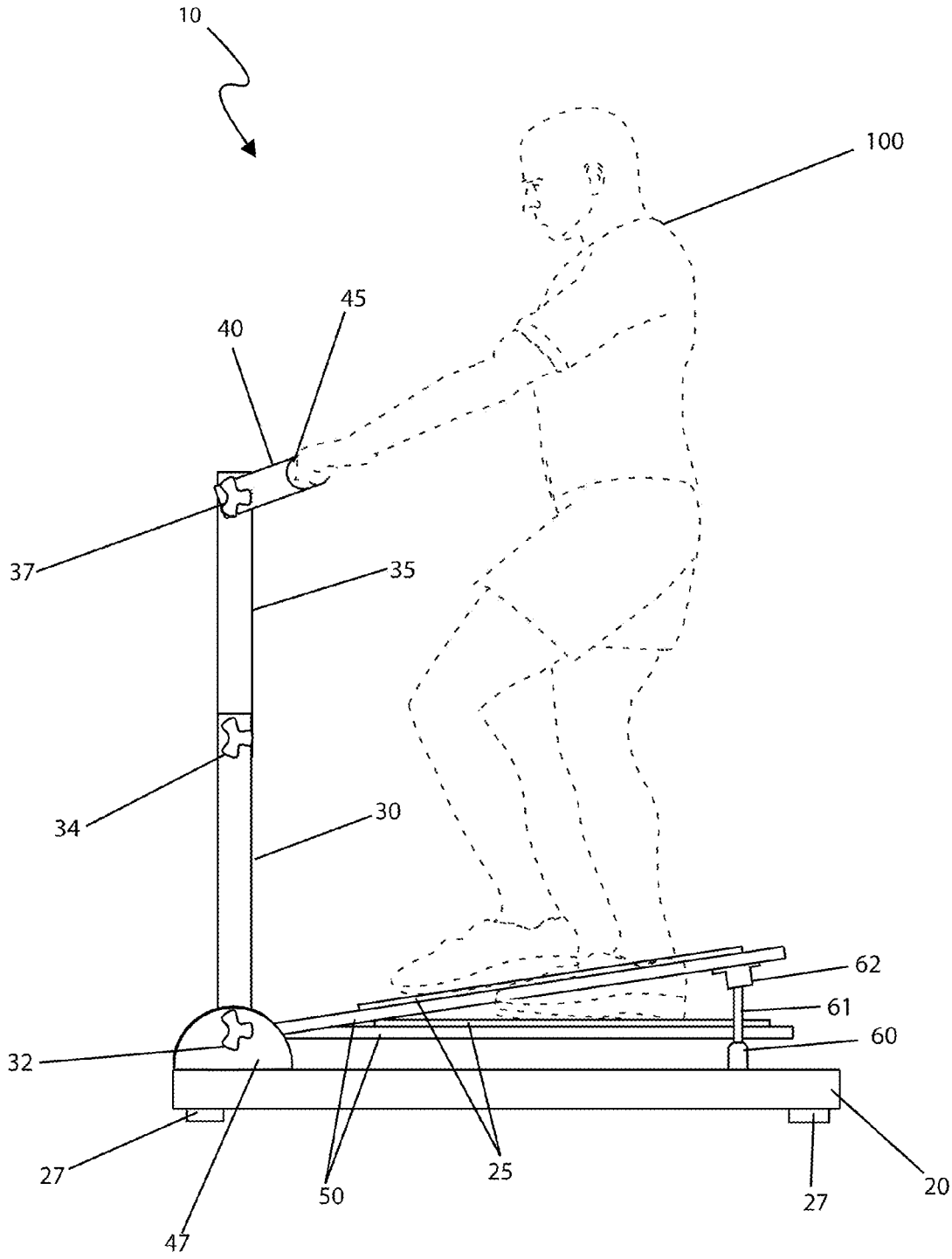
FIG. 1 is a side view of a collapsible step exercising machine 10 depicting an in-use state, according to the preferred embodiment of the present invention; and, FIG. 2*a* is a side perspective view of a collapsible step exercising machine 10 in an unfolded orientation, according to the preferred embodiment of the present invention.
Figure 2A:
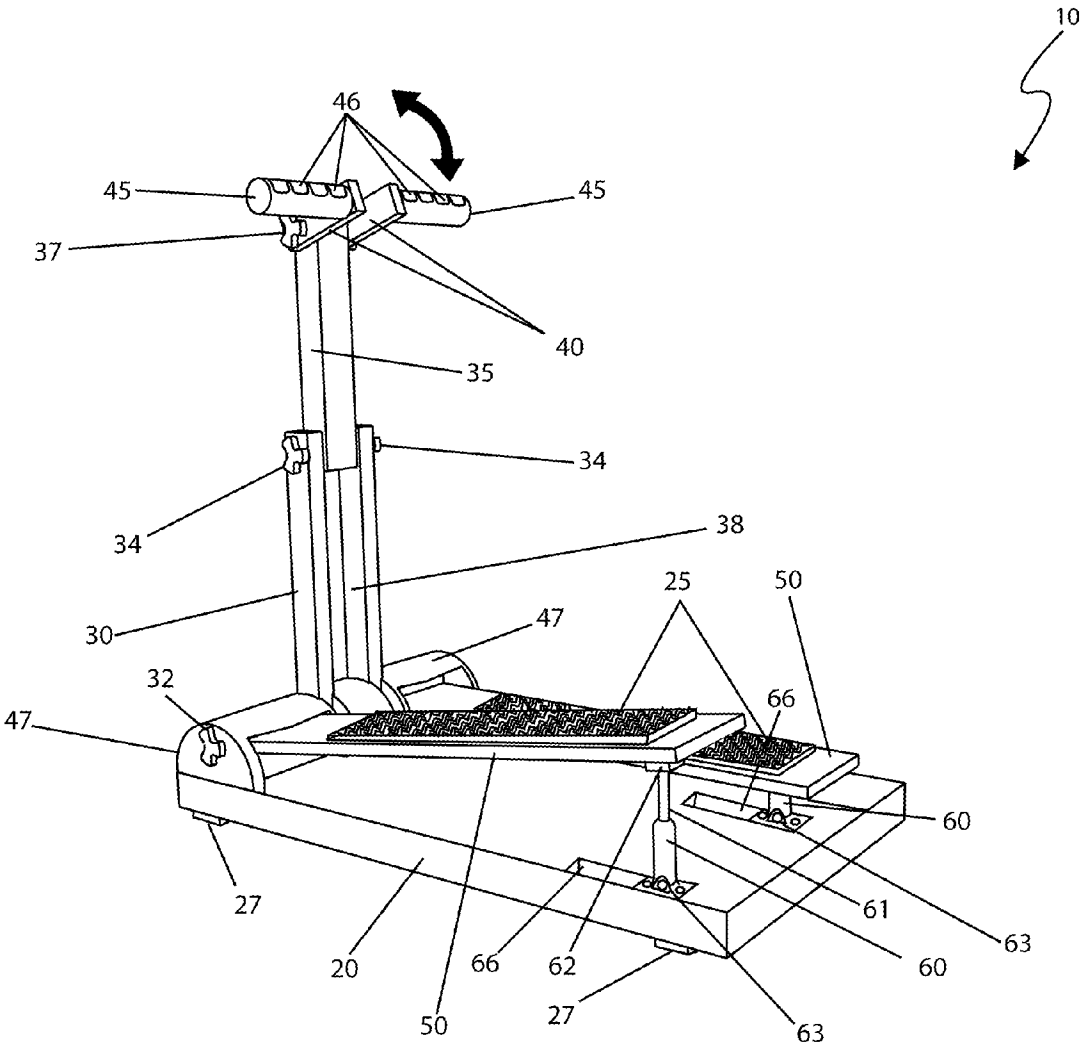
FIG. 2*b* is an exploded view of an upper support member portion 35 of the collapsible step exercising machine 10, according to the preferred embodiment of the present invention.
Figure 2B:
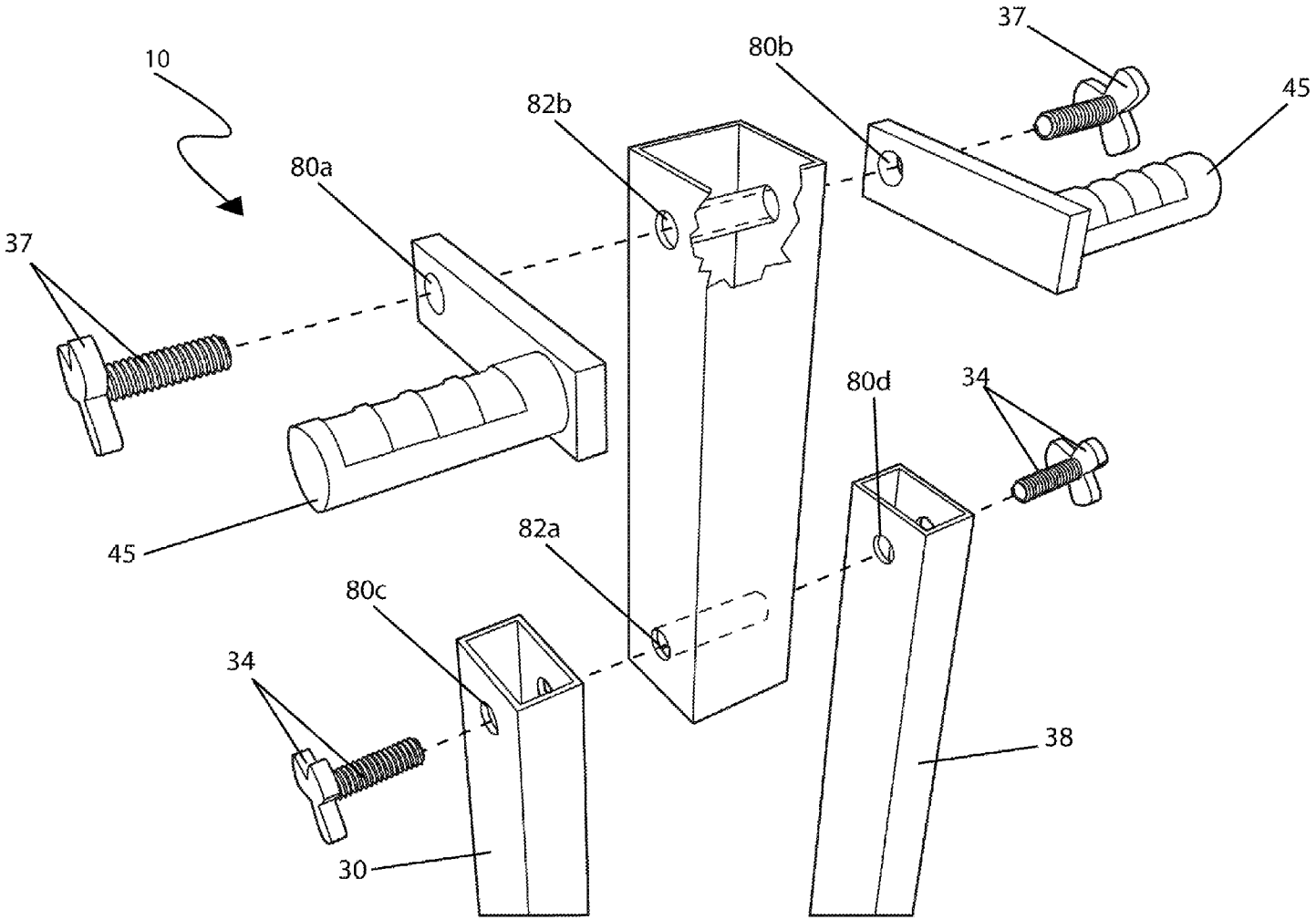
Figure 3A:
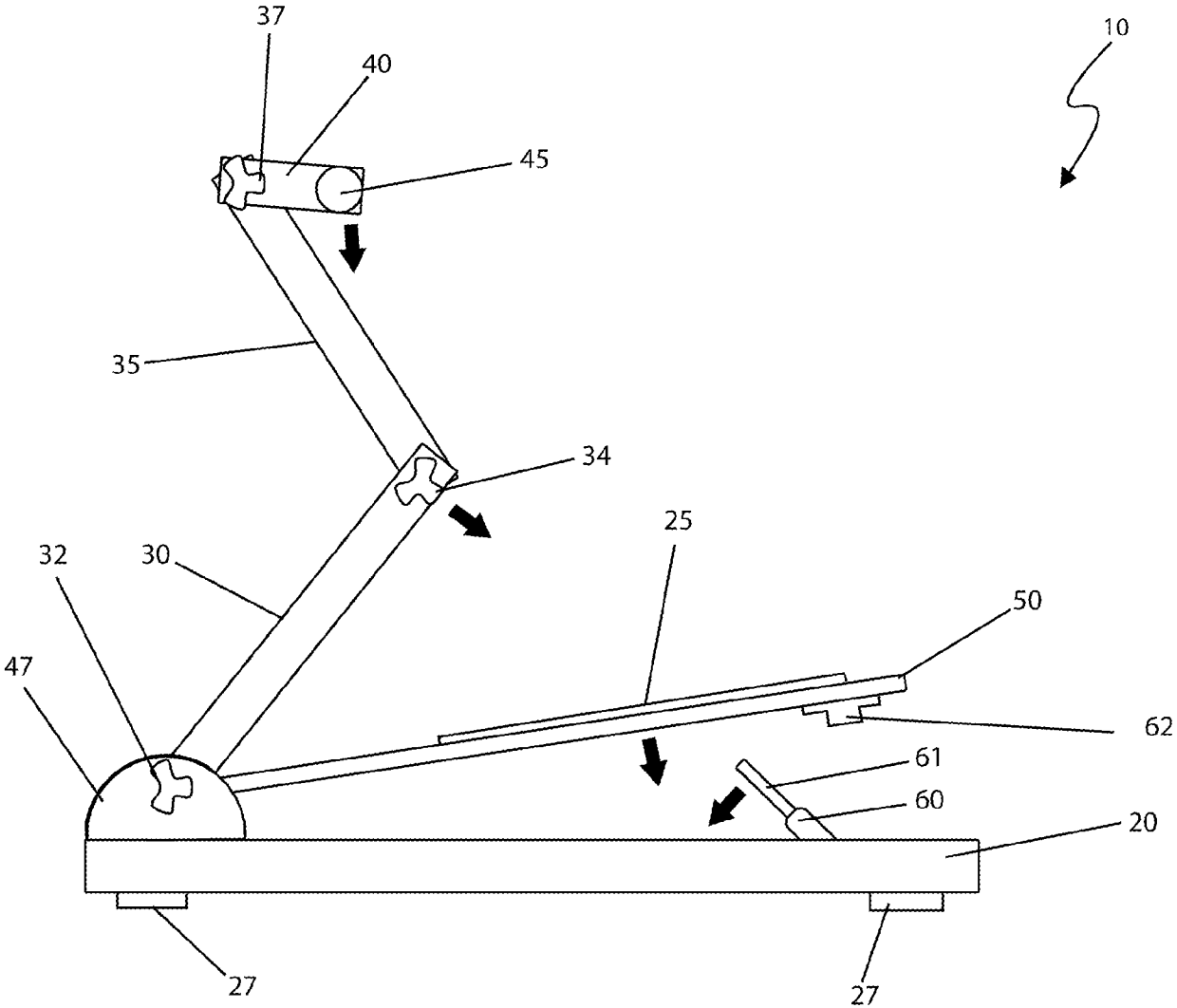
FIGS. 3*a* and 3*b* are a side perspective views of the collapsible step exercising machine 10 in a folded orientation, according to the preferred embodiment of the present invention.
Figure 3B:
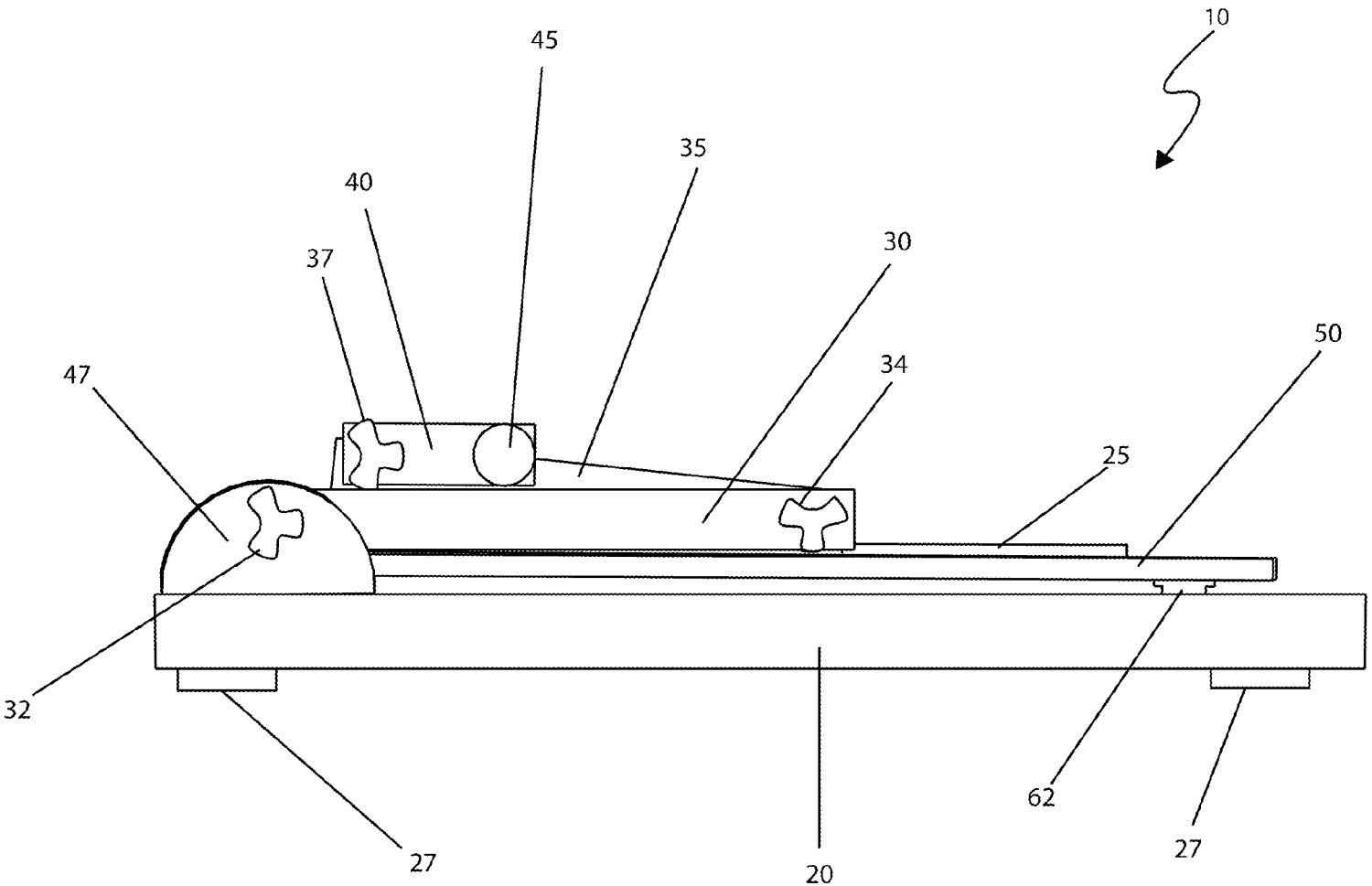

10 collapsible step exercising machine
20 base
25 tread
27 foot pad
30 first lower support member
31 horizontal axle
32 first knob
34 second knob
35 upper support member
37 third knob
38 second lower support member
40 handlebar
43 outer cover
44 padding
45 handlebar grip
46 recessed finger section
47 median member
50 stepping pedal
60 pneumatic shock absorber
61 cylinder shaft
62 coupling
63 pivoting member
64 spring
65 fastener
66 shock absorber cavity
67 motion control feature
70*a* first clamping block
70*b* second clamping block
72 stationary clamping block
75*a* first threaded portion
75*b* second threaded portion
80*a* first through-hole
80*b* second through-hole
80*c* third through-hole
80*d* fourth through-hole
82*a* first threaded hole
82*b* second threaded hole
100 user

DETAILED DESCRIPTION OF THE PREFERRED EMBODIMENT

Figure 4:
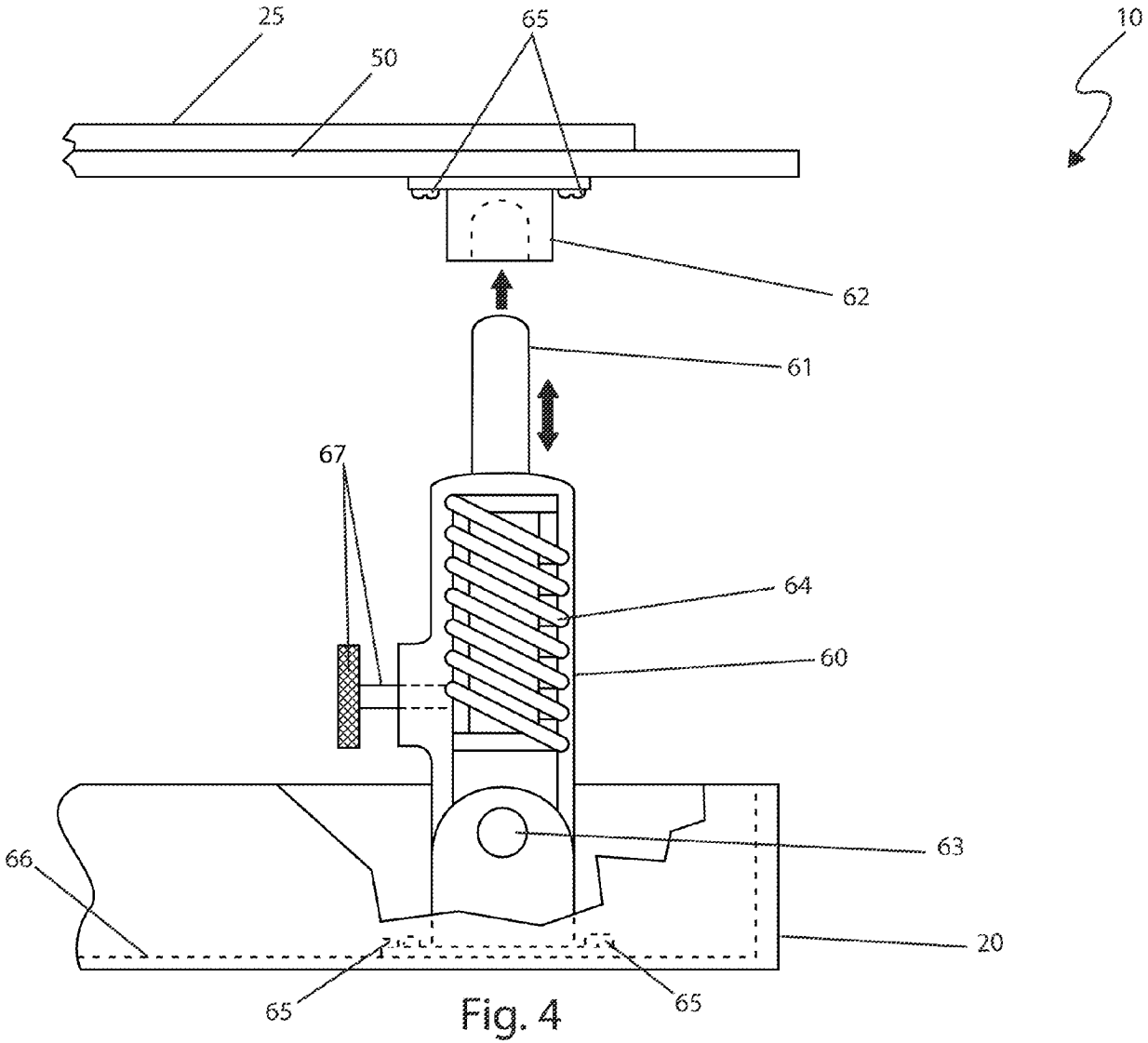
FIG. 4 is a close-up view of a pneumatic shock absorber 60 portion of the collapsible step exercising machine 10, according to the preferred embodiment of the present invention.
Figure 5B:
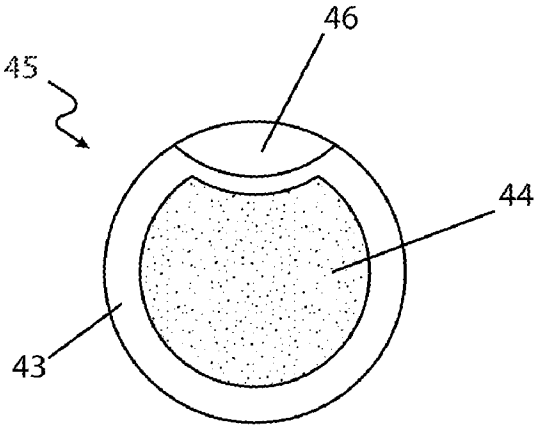
FIG. 5*b* is a sectional view taken along the lines B-B of FIG. 5*a* of the handlebar portion 40, according to the preferred embodiment of the present invention; and, FIG. 6 is a sectional view taken along the lines of A-A of FIG. 2 of the collapsible step exercising machine 10, according to the preferred embodiment of the present invention.
Figure 5A:
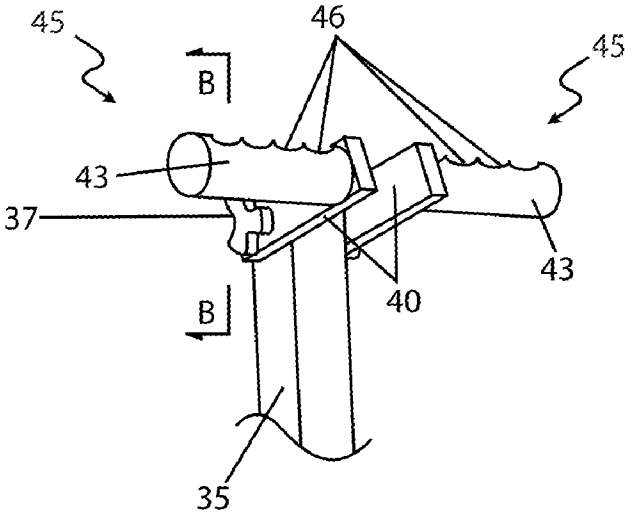
FIG. 5*a* is a close-up view of the handlebar grip 45, showing a plurality of recessed finger sections 46 of the collapsible step exercising machine 10, according to the preferred embodiment of the present invention.
Figure 6:
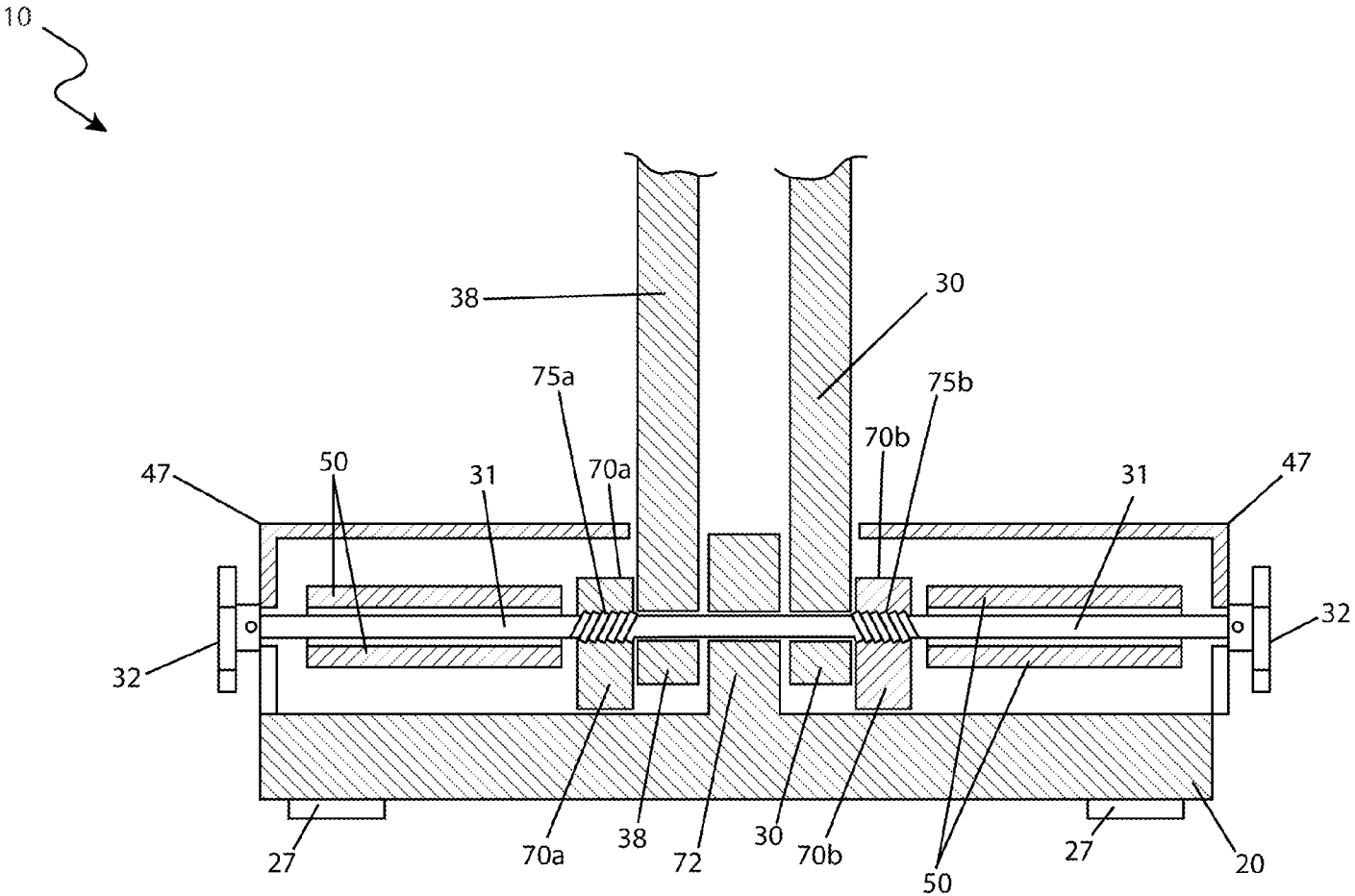

The best mode for carrying out the invention is presented in terms of its preferred embodiment, herein depicted within FIGS. 1 through 4 and 6 and alternately in FIGS. 5*a* and 5*b*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and that example configurations shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method that discloses a portable stair-stepping exercise machine and method of use for developing certain muscle groups by emulating a stair climbing motion. The collapsible step exercising machine (herein described as the "apparatus") 10, provides independent movable stepping pedals 50 for each foot along with independent pneumatic shock absorbers 60. The apparatus 10 provides a significantly smaller size and profile than its conventional stepper units. A vertical support arm comprising a first lower support member 30 and an upper support member 35 provides stable grasping of the apparatus 10 to a user 100 and collapses for easy storage and transportation. The size and weight of the apparatus 10 makes it ideal for transportation while traveling or for use in an area with restricted space in which the apparatus 10 may be stored away after use. The use of the apparatus 10 provides a user 100 an invigorating workout virtually anywhere and anytime.

Referring now to FIGS. 1 through 3*b* and 6, views of the apparatus 10, according to the preferred embodiment of the present invention, are disclosed. The apparatus 10 comprises a base frame 20, two (2) stepping pedals 50 pivotally attached to pivoting assembly, a base frame 20, a median member 47, a first lower support member 30, a second lower support member 38, an upper support member 35, and a pair of handlebars 40 being pivotally attached thereto said upper support member 35. The apparatus 10 is envisioned to be fabricated of light-weight materials such as, but not limited to: steel, aluminum, or the like. The metallic components would be purchased in raw stock form and then cut to desired lengths; finished; and assembled for utilization. A base member 20 comprises a rectangular platform approximately twenty-four (24) inches wide and thirty (30) inches long providing support thereto the apparatus 10 during cardiovascular exercises. Said base 20 comprises a floor portion being approximately one (1) inch thick further comprising integral features including a pair of recessed rectangular shock absorber cavities 66 along a rear portion, and an upwardly protruding stationary clamping block 72 located at a forward area of said base 20 (see FIGS. 2*a* and 6). The base 20 comprises a light-weight five-sided box structure having an open top portion for optimum stability and strength having overall dimensions sizable to accommodate the weight of the apparatus 10 and the user 100 while still being lightweight and sized for portability. The bottom of the base 20 provides a plurality of attached rubber feet 27 comprising rectangular or round pads providing a protection means to floors from scraping, scratching, rubbing, and the like. The feet 27 are envisioned being made using materials such as, but not exclusively, vulcanized rubber, urethane, or the like. The rubber feet 27 would be affixed to a bottom surface of the base 20 using common fastening means 65 such as adhesives, screws, staples, and the like. However, the apparatus 10 may be introduced having other skid-proof means such as a rubberized surface, wheels, or the like to minimize damage done to rugs, hardwood floors, ceramic floors, or other floors.

The base member 20 further comprises a median member 47 extending laterally across a forward edge providing an enclosure means to a pivoting assembly. The median member 47 comprises a half-cylinder shape enclosure providing a mounting, clamping, and housing means to said internal pivoting assembly which further comprises a horizontal axle 31 providing an attachment and clamping means to the first lower support member 30 and second lower support member 38 being rotatingly attached. The pivoting assembly provides a means to clamp the first 30 and second 38 lower support members in a vertical position via a rotatingly operable pair of first knobs 32, a first clamping block 70*a*, a second clamping block 70*b*, and a stationary clamping block 72. Said first 70*a* and second 70*b* clamping blocks are threadingly engaged with respective first 75*a* and second 75*b* threaded portions of the horizontal axle 31. Said first 75*a* and second 75*b* threaded portions comprises respective integral right and left threaded sections of said horizontal axle 31, thereby horizontally motioning said first 70*a* and second 70*b* clamping blocks synchronously inwardly or outwardly as the horizontal axle 31 is rotated using the first knobs 32. The stationary clamping block portion 72 of the base 20 is positioned between the first 30 and second 38 lower support members, thereby being clamped between respective converging first 70*a* and second 70*b* clamping blocks and the stationary clamping block 72 as the first knob portions 32 of the horizontal axle 31 are rotated. Said first lower support member 30, second lower support member 38, first clamping block 70*a*, second clamping block 70*b*, and the stationary clamping block 72 provide compressed mating surfaces which secure the first 30 and second 38 lower support members in a vertical position upon rotation of the first knobs 32 extending outwardly from opposite outer surfaces of the median member 47. The first knobs 32 comprise common three (3) or four (4) prong plastic knobs affixed to end portions of the first pivoting member 31, thereby enabling positioning of said first 30 and second 38 lower support members at a desired vertical orientation during use, or in a horizontal orientation during transport or storage of the apparatus 10 (see FIG. 6).

The first 30 and second 38 lower support members comprise a pair of parallel rectangular cross-sectional metal tubes projecting vertically upwards from the first pivoting member 31. The first 30 and second 38 lower support members provide a rotating and clamping attachment means to an upper support member 35 via a pair of second knobs 34. Said second knobs 34 comprise common stud/knob fittings being inserted through third 80*c* and fourth 80*d* through-hole portions of respective first 30 and second 38 lower support members and subsequently threadingly engage a first threaded hole portion 82*a* of the upper support member 35 (see FIG. 2*b*). The upper support member 35 comprises a single rectangular cross-sectional tube projecting vertically upwards further comprising a first threaded hole 82*a* and a second threaded hole 82*b* which provide tightening engagement of respective second 34 and third 37 knobs (see FIG. 2*b*). When in use, the first 30 and second 38 lower support members and the upper support member 35 are envisioned to be aligned with each other in a generally vertical direction. Said first 30 and second 38 lower support members and the upper support member 35 provide a compact storage means when folded upon each other along the base member 20 (see FIGS. 3*a* and 3*b*).

The upper support member 35 provides a pivotally coupled attachment at an upper portion thereto the handlebars 40 via a pair of third knobs 37 being similar to the aforementioned second knobs 34. Said third knobs 37 are inserted through first 80*a* and second 80*b* through-hole portions of respective handlebars 40 and subsequently threadingly engage a second threaded hole portion 82*b* of the upper support member 35 (see FIG. 2*b*). The handlebar 40 provides a grasping and stabilizing means thereto a user 100 in an expected manner while operating the apparatus 10. The handlebar 40 comprises a pair of "L"-shaped metal structures extending rearwardly toward said user 100 and having a pair of handle grips 45 extending perpendicularly outward from at a proximal end of the handlebar 40. The handlebar 40 further provides a height adjustment means thereto said handle grips 45 being rotatingly attached to the upper support member 35 via the third knobs 37 and being angularly adjustable upwardly or downwardly from a horizontal plane. The handlebar 40 is clampable at a desired angle and height in relation thereto the upper support member 35 via the pair of manually tightened third knobs 37 located upon opposite outer surfaces of each handlebar portion 40. The third knobs 37 comprise similar stud/knob components as the aforementioned second knobs 34.

The pivoting assembly of the median member 47 also provides a rotating attachment means thereto two (2) stepping pedals 50 along opposing side portions of the median member 47 which provide resistive movement of a user's legs 100 to simulate a motion of going up and going down a staircase. The stepping pedals 50 comprise flat stepping surfaces approximately eight (8) inches wide extending the length of the base 20 being substantially identical to each other and pivotally connected to the median member 47. Each stepping pedal 50 comprises a high-friction tread 25 covering preferably half of a top surface of said stepping pedals 50 being bonded to said stepping pedal 50 using common attachment methods such as adhesives, screws, or the like. The tread 25 further comprises a compression mat having a plurality of non-slip molded-in ridges protruding along a top surface thereof. The tread 25 is utilized to absorb a portion of the user's weight 100, thereby reducing skidding, shock, and vibration thereto a user's feet 100 in an expected manner. The rearward portion of the stepping pedals 50 provide an attachment means thereto respective pneumatic shock absorbers 60. When in use, the operator initiates an alternating stepping pattern as one (1) stepping pedal 50 is in a lower position, the opposing stepping pedal 50 is in an upper position and so on. Upon applying a stepping force to each stepping pedal 50, a respective subjacent pneumatic shock absorber 60 applies a counteractive resistive force (see FIG. 4).

Referring now to FIG. 4, a close-up view of a pneumatic shock absorber 60 portion of the collapsible step exercising machine 10, according to the preferred embodiment of the present invention. The apparatus 10 comprises two (2) pneumatic shock absorbers 60 pivotally attached thereto a rearward portion of said base frame 20 via respective pivoting members 63 and removably attached to respective stepping pedals 50 via an extended cylinder shaft 61 and a coupling 62. The coupling 62 is affixed along a lower surface of the stepping pedal 50 using common fasteners 65 and comprises an inverted female-type fixture formed so as to receive a rounded upper end portion of the cylinder shaft 61 providing a pivoting motion therein during use. As each stepping pedal 50 descends, the respective pneumatic shock absorber 60 applies a counteractive resistive force via a common pneumatic shock absorber device having a spring unit which acts to return said respective stepping pedal 50 to a raised position. The apparatus 10 is illustrated here comprises a pair of pneumatic shock absorbers 60 with integral springs 64 to provide an upward return force and a stepping resistance; however, it is understood that various resistance producing methods and devices such as hydraulic, electro-magnetic, or the like, may be provided without deviating from the concept and scope of the invention 10. Further, the pneumatic shock absorbers 60 comprise common motion control features 67 further comprising a needle valve device being similar to those made by the ENDINE® company being commonly used in industrial shock absorber applications. The resistance of said motion control features 67 are operably adjustable by a user via threaded rod and accessible knob portions. Said motion control features 67 provide a valving function to control a flow of hydraulic fluid through an internal hydraulic circuit within the shock absorber 60. Said adjustability of the shock absorbers 60 allows a user 100 to adjust speed and resistance, thereby customizing the apparatus 10 to a user's 100 weight, fitness level, and/or desired difficulty level during a training session. The pneumatic shock absorbers 60 provide a compact storage means to the apparatus 10 via the pivoting members 63 and respective shock absorber cavities 66 formed along a rear upper surface of the base 20. During collapsing of the apparatus 10 the cylinder shaft 61 is detached from the coupling 62 by lifting a respective stepping pedal 50 and pivoting the pneumatic shock absorbers 60 about the pivoting members 63 until being contained within the recessed shock absorber cavities 66 which comprise rectangular depressions in the base 20 allowing storage of said pneumatic shock absorbers 60 below an upper surface of said base 20. Storage of the pneumatic shock absorbers 60 as previously described allows the stepping pedals 50 to lie compactly against the base 20 (see FIGS. 3*a* and 3*b*).

Referring now to FIGS. 5*a* and 5*b*, close-up and sectional views of a handlebar grip portion 45 of the apparatus 10, according to the preferred embodiment of the present invention, is disclosed. The handle grips 45 are envisioned to provide expected features such as, but not limited to: recessed finger sections 46 shaped to accommodate an average person's hand, a high-friction outer covering 43, and foam rubber padding 44.

The preferred embodiment of the present invention can be utilized by the common user in a simple and effortless manner with little or no training. After initial purchase or acquisition of the apparatus 10, it would be configured as indicated in FIGS. 1 through 4.

The method of utilizing the apparatus 10 may be achieved by performing the following steps: placing the apparatus 10 on a desired ground or floor surface; loosening the first 32 and second 34 knobs; pivotally extending the first 30 and second 38 lower support members and the upper support member 35 about the pivoting assembly and said second knobs 34 to a generally vertical position perpendicular to the base 20; securing the first 30 and second 38 lower support members and the upper support member 35 in position by tightening the first 32 and second 34 knobs; loosening the third knobs 37; pivotally extending the handlebars 40 upwardly to a generally horizontal orientation; adjusting the handlebar 40 to obtain a desired grasping height thereof; tightening the third knobs 37 to secure a position of the handlebar 40; pivoting each of the pneumatic shock absorbers 60 upwardly from the shock absorber cavities 66 about the pivoting member 63; inserting the cylinder shaft portions 61 of said pneumatic shock absorbers 60 in respective couplings 62; adjusting the resistance level of the pneumatic shock absorbers 60 with the motion control feature 67, as desired; grasping the handlebar grip portion 45 of the handlebar 40; stepping upon the stepping pedals 50 with both feet; initiating a stepping exercise motion by depressing one (1) stepping pedal 50 downwardly whilst the opposing stepping pedal 50 is released to a raised position by removing one's applied weight from; releasing one's weight upon said depressed pedal 50 allowing it to return to a raised position while coincidentally depressing the opposing stepping pedal 50; alternating a depressing and releasing motion in rhythmic manner for a period of time to complete an exercise session; and, benefiting from reduced size, portability, and quick set-up of the apparatus 10 regardless of a user's location.

The apparatus 10 provides a compact collapsed form providing a convenient storage and/or transportation means and may be configured as such by reversing the above described steps, thereby utilizing the first knobs 32, second knobs 34, and third knobs 37.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A stair-stepping exercise machine for developing certain muscle groups by emulating a stair climbing motion comprises:

a base frame;

a median member located on a upper front edge of said base frame and extending therealong, further comprising a half-cylinder shape enclosure housing an internal pivoting assembly;

a pair of independently movable and parallel stepping pedals, each comprising a first end operably connected to said pivoting assembly and rearwardly extending from said median member and terminating at a second end;

a pair of pneumatic shock absorbers, one for each of said pair of independent movable stepping pedals, each shock absorber mounted to said base frame and said second end of each of said pair of stepping pedals;

a vertical support arm axially attached to said median member and comprising a first lower support member, a second lower support member, and an upper support member; and, a handlebar assembly pivotally attached to said upper support member;

wherein said first and second lower support members are rotatingly attached to said pivoting assembly;

wherein said upper support member is rotatingly attached to said first and second lower support members;

wherein said handlebar assembly is rotatingly attached to said upper support member;

wherein a user initiates an alternating stepping pattern by applying a stepping force as one stepping pedal is in a lower position and an opposing stepping pedal is in an upper position;

wherein upon applying said stepping force to each stepping pedal, a said pair of pneumatic shock absorbers apply a counteractive resistive force;

wherein said exercise machine is collapsible between a deployed configuration and a compact collapsed configuration;

wherein said vertical support arm may be stably grasped by a user of said exercise machine; and, wherein said base frame comprises a light-weight five-sided box structure having an open top portion for optimum stability and strength and further comprises a floor portion having a pair of recessed shock absorber cavities along a rear portion, each receiving one of said pair of shock absorbers.

2. The exercise machine of claim 1, wherein said base frame further comprises a plurality of attached rubber feet thereto a bottom surface of said base frame;

wherein said plurality of attached rubber feet protects a surface from damage when said exercise machine is placed thereon.

3. The exercise machine of claim 2, wherein said base frame comprises a rectangular platform approximately twenty-four (24) inches wide and thirty (30) inches in length.

4. The exercise machine of claim 1, wherein said pivoting assembly further comprises compressed mating surfaces thereof using a pair of first knobs located along opposite ends of a horizontal axle and extending through opposing outer surfaces of the median member, said pivoting assembly threadingly clamps and secures said first lower support member and said second lower support member at a desired first vertical orientation during use, or therein a horizontal orientation during transport or storage of said exercise machine;

wherein either of said pair of first knobs may be operably manipulated to achieve said clamping and securing of said first lower support member and said second lower support member at said desired first vertical orientation or said horizontal orientation.

5. The exercise machine of claim 4, wherein said pivoting assembly further comprises:

said horizontal axle further comprising a first threaded portion having right-handed threads and a second threaded portion having left-handed threads;

said pair of first knobs located on opposing sides of said horizontal axle;

a first clamping block threadingly engaged with said first threaded portion of said horizontal axle;

a second clamping block threadingly engaged with said second threaded portion of said horizontal axle;

a stationary clamping block portion upwardly projecting from an inner bottom surface of said base and positioned between said first and second lower support members;

wherein rotation of either of said pair of first knobs operably drives said horizontal axle in a synchronous manner inwardly to drive said first clamping block to abut said first lower member against a first side of said stationary clamping block, and operably drives said second clamping block to abut said second lower member against a second side of said stationary clamping block, respectively, or outwardly to loosen said first clamping block and said second clamping block.

6. The exercise machine of claim 5, wherein said pair of first knobs each comprise common three (3) or four (4) prong plastic knobs.

7. The exercise machine of claim 5, further comprising:

said first lower support member and said second lower support member further comprise a pair of parallel rectangular cross-sectional metal tubes projecting vertically upwards therefrom said pivoting assembly;

said upper support member comprises a single rectangular cross-sectional tube projecting vertically upwards; and, a pair of second knobs securedly attaching said first and second support members to said upper support member;

wherein said upper support member is relatively positioned with respect to said first and second lower support members at a first desired angular orientation between said deployed orientation and said compact collapsed orientation; and, wherein said pair of second knobs secures said first desired angular orientation when tightened.

8. The exercise machine of claim 7, further comprising:

said pair of second knobs each comprising a threaded shaft;

a first through-hole located on an upper portion of said first lower support member;

a second through-hole located on an upper portion of said second lower support member; and, a first threaded hole portion routed through a lower portion of said upper support member;

wherein said first through-hole and said second through-hole are each horizontally aligned with said first threaded hole;

wherein one of said pair of second knobs engages said first threaded portion through said first through-hole and another one of said pair of second knobs engages said first threaded portion through said second through-hole; and, wherein full insertion of both of said pair of second knobs within said first threaded portion do not interfere with each other.

9. The exercise machine of claim 8, wherein said pair of second knobs each comprise common three (3) or four (4) prong plastic knobs.

10. The exercise machine of claim 7, wherein said handlebar assembly comprises a rearwardly extending "L"-shaped metal structure and further comprises:

a pair of handle grips extending perpendicularly outward from said handlebar assembly;

a third pair of knobs securedly attaching said handlebar assembly to said upper support member;

wherein said handlebar assembly is relatively positioned with respect to said upper support member at a desired angular orientation between said deployed orientation and said compact collapsed orientation; and, wherein said pair of third knobs secures said desired second angular orientation when tightened.

11. The exercise machine of claim 10, further comprising:

said pair of third knobs each comprising a threaded shaft;

a third through-hole located on one of said pair of handle grips;

a fourth through-hole located on another one of said pair of handle grips; and, a second threaded hole portion routed through an upper portion of said upper support member;

wherein said third through-hole and said fourth through-hole are each horizontally aligned with said second threaded hole;

wherein one of said pair of third knobs engages said second threaded portion through said third through-hole and another one of said pair of third knobs engages said second threaded portion through said fourth through-hole; and, wherein full insertion of both of said pair of third knobs within said second threaded portion do not interfere with each other.

12. The exercise machine of claim 11, wherein said handlebar assembly further comprises:

a plurality of recessed finger section;

a high-friction outer covering; and, a foam rubber padding.

13. The exercise machine of claim 12, wherein said pair of third knobs each comprise common three (3) or four (4) prong plastic knobs.

14. The exercise machine of claim 7, wherein said pair of stepping pedals each further comprises:

an upper surface and a bottom surface; and, a high-friction tread covering a rearward portion of said upper surface;

wherein said tread is utilized to absorb a portion of a weight of a user, thereby reducing skidding, shock, and vibration to feet of said user.

15. The exercise machine of claim 14, wherein said tread further comprises a compression mat having a plurality of non-slip molded-in ridges protruding along a top surface thereof.

16. The exercise machine of claim 14, wherein said stepping pedals each comprises a width of approximately eight (8) inches and extends along a length of said base frame.

17. The exercise machine of claim 7, wherein said pair of pneumatic shock absorbers each further comprise:

a pivoting member attached to a rearward portion of said base frame;

an extended cylinder shaft removably attached to a coupling attached to said bottom surface of each of said pair of stepping pedals; and, an internal spring system attached to said cylinder shaft;

wherein said coupling comprises an inverted fixture formed so as to receive a rounded upper end portion of said cylinder shaft, thereby providing a pivoting motion therein;

wherein said internal spring system applies a counteractive resistive force which acts to return one of said pair of pedals to said upper position; and, wherein each said pivoting member enables said pair of pneumatic shock absorbers to fully reside within said shock absorber cavity during said compact collapsed configuration.

18. The exercise machine of claim 17, further comprising motion control features allowing said user to adjust speed and resistance of said pneumatic shock absorbers operably adjustable via a threaded rod and accessible knob portions to control a flow of hydraulic fluid through an internal hydraulic circuit, thereby customizing said exercise machine based on a weight of said user, a fitness level of said user, and a desired difficulty level during a training session.

19. The exercise machine of claim 18, wherein said pair of pneumatic shock absorbers each comprise a needle valve.

* * * * *